US005658188A

United States Patent [19]

Yamada et al.

[11] Patent Number: 5,658,188

[45] Date of Patent: Aug. 19, 1997

[54] METHOD FOR GRINDING GOLF BALL SURFACE AND GOLF BALL

[75] Inventors: Mikio Yamada, Kobe; Yoshikazu Yabuki, Akashi, both of Japan

[73] Assignee: Sumitomo Rubber Industrues, Ltd., Kobe, Japan

[21] Appl. No.: 404,716

[22] Filed: Mar. 15, 1995

[30] Foreign Application Priority Data

Mar. 18, 1994 [JP] Japan ..... 6-074433

[51] Int. Cl.[6] ..... B24B 1/00

[52] U.S. Cl. ..... 451/50; 451/49; 451/449

[58] Field of Search ..... 451/28, 49, 50, 451/262, 268, 449

[56] References Cited

U.S. PATENT DOCUMENTS 2,994,993 8/1961 Jones ..... 451/286

3,133,383 5/1964 Chapman ..... 51/117

3,640,028 2/1972 Richard ..... 51/289

FOREIGN PATENT DOCUMENTS 1161091 8/1969 United Kingdom .

*Primary Examiner*—Eileen P. Morgan

*Attorney, Agent, or Firm*—Armstrong Westerman Hattori McLeland & Naughton

[57] ABSTRACT

A method for grinding a surface of a golf ball and removing the thin outer layer thereof, wherein grinding tools arranged on three axes on a plane which axes radiate from a definite point at intervals of 120° between one another are used. Each of the grinding tools possesses a circular grinding face which gradually spreads toward the end and contacts a surface of a golf ball. The grinding tools turn on the respective axes toward the same direction at the same speed keeping the same distance from the definite point.

8 Claims, 4 Drawing Sheets

METHOD FOR GRINDING GOLF BALL SURFACE AND GOLF BALL

BACKGROUND AND SUMMARY OF THE INVENTION

The present invention relates to a method for grinding a golf ball surface and to a golf ball.

The kinds of golf balls generally used are a balata covered, wound core ball for professional golfers and accomplished amateurs, a wound core ball covered with ionomer having durability against cuts for general amateurs, a two-piece solid ball covered with ionomer having durability against cuts for general amateurs, and a one-piece solid ball for training purposes.

Golf balls with ionomer covers such as the ionomer covered wound core ball and the ionomer covered solid ball, have recently become popular however, the surfaces of these ionomer covered balls are prone to chunking caused by grooves in the faces of golf clubs.

On one hand, when a golf ball covered with balata or soft urethane is hit by a golf club, the face grooves of the club put better spin on the ball owing to softness of the cover. On the other hand, when a golf ball covered with ionomer of relatively high rigidity having durability against cuts is hit by a golf club, despite the painting on the surface, the face grooves of the club (especially if a short iron, such as a No. 9 iron, a pitching wedge, or a sand wedge) scrape off a cover portion along with a portion of the paint covering the ball owing to the hardness of the cover (this phenomenon is called "chunking").

The phenomenon is caused by the method employed to form a golf ball from ionomer material in which ionomer material is melted to approximately 130°–170° C. in the case of compression molding or approximately 180°–250° C. in the case of injection molding, poured into the metallic mold, and cooled and hardened to form a ball. To be precise, it should be understood that a surface of a ball covered with ionomer resin is prone to be scraped off along with paint by grooves on a face of a golf club (specifically an iron club), because when the molten ionomer resin is cooled and hardened and touches the metallic surface, the olefin (for example, ethylene) and a copolymerization component of unsaturated carboxylic acid and metal-ionized in part, which are the components of the ionomer resin, are not distributed uniformly, and the surface portion being covered with olefin, results in relatively weak adhesion of the paint and low flexibility of the exterior surface portion of the ionomer cover.

Therefore, grinding aid removing a thin outer layer of the surface portion increases surface activeness and adhesion of paint, and a golf ball durable against chunking can be obtained, because a golf ball is formed by cooling and hardening a heated and melted resin inside a metallic mold. Conventionally, a whole surface of a golf ball is ground (polished) at a time without removing flashes at the equatorial position (the parting plane) of the ball beforehand.

In order to uniformly grind the surface, as well as completely remove the flashes at the equatorial position, the grinding amount needs to be at least approximately 3/100 mm (normally approximately 5/100 mm), which changes the dimples of each golf ball in size and depth. Therefore, the conventional method is not favorable in view of flying performance of the ball.

The grinding face of a conventional grinding tool is a concave curved face having the same radius of curvature as the radius of the golf ball and the area contacting with the bali is relatively large. Thus, when the golf ball is ground, the temperature of the ball surface becomes relatively high, which melts the resin, therefore the conventional method is not favorable also in view of its inability to grind the ball surface into an attractive, smooth surface.

It is therefore an object of the present invention to provide a method for grinding a golf ball surface in which a golf ball, durable against chunking, is obtained by grinding and removing a thin outer layer of a golf ball without excessively raising the temperature of the ball surface.

It is another object of the present invention to provide a golf ball wherein adhesion of the paint thereof is strong and the dimples thereof have accurate configurations and dimensions.

DESCRIPTION OF THE PREFERRED EMBODIMENTS

Preferred embodiments of the present invention will now be described with reference to the accompanying drawings.

Figure 5:
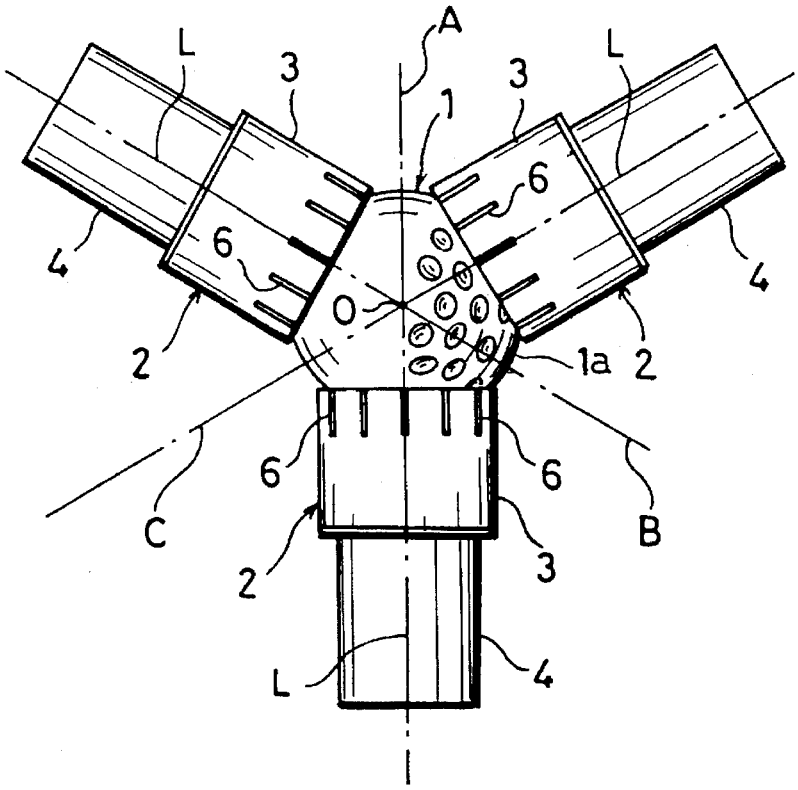
FIG. 5 is a schematic view showing a grinding situation.

FIG. 5 shows an apparatus for grinding a golf ball surface used in the method for grinding a golf ball surface according to the present invention under a situation of grinding a surface 1*a* of a golf ball 1.

This apparatus is provided with grinding tools 2 whose center lines are placed on three axes A, B, and C on a plane, which axes radiate from a definite point O at intervals of 120° between one another. By way of parenthesis, the angles of 120° between each two of the three axes A, B, and C are merely approximate in the present invention.

Figure 2:
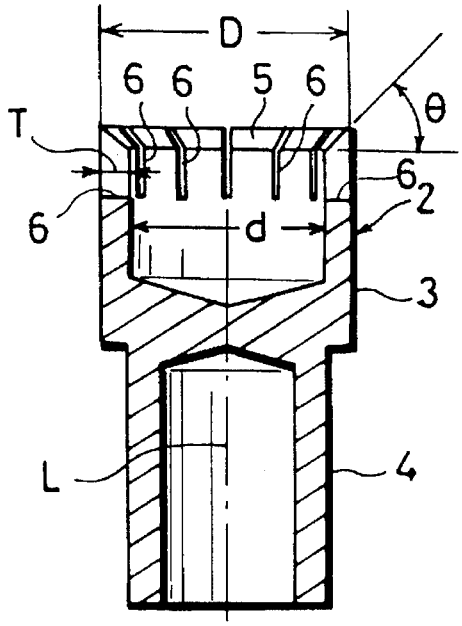
FIG. 2 is a sectional view of the grinding tool.

Each grinding tool 2 consists of a main body portion 3 having a configuration including a bottomed cylinder and a cylindrical shaft portion 4 connected to said main body portion 3, as shown in FIG. 2.

An end face of the main body portion 3 is provided with a circular notched portion, whose sectional area is configured as a right-angled triangle, forming a circular grinding face 5 gradually spreading toward the end. At least said grinding face 5 is a whetstone (bonded abrasive grains). That is to say, a layer of a uniform thickness from the grinding face 5 can be a whetstone, the whole main body portion 3 can be a whetstone, or the whole grinding tool 2 can be a whetstone.

In this case, the angle of inclination θ of the circular grinding face 5 is arranged to be approximately 45° (to be more precise, in the range of 39°–51° ).

As a result, the radius of curvature R of the circular grinding face 5 (see FIG. 1), which is the radius of curvature of the grinding face 5 at a sectional area of the grinding tool 2 including the axis (the center line) L, is infinite (∞) because the grinding face 5 is planar. The radius of curvature R is therefore arranged to be larger than a radius r of a golf ball 1, whose flashes at the equatorial position have been removed after molding of the golf ball 1, to be ground with this apparatus.

Figure 3:
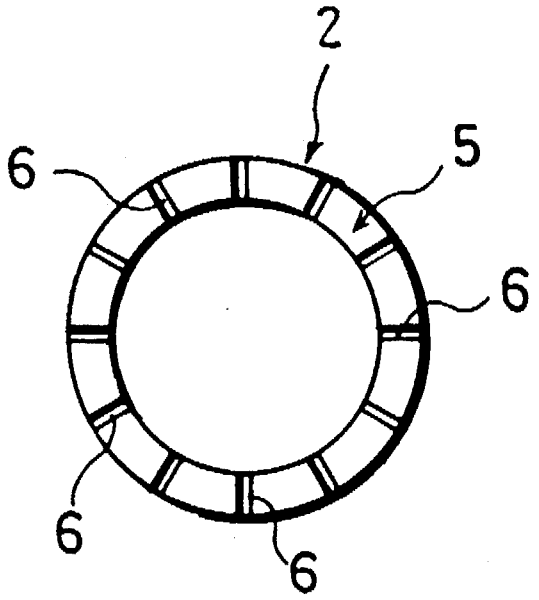
FIG. 3 is a plan view of the grinding tool.

It is preferable to provide a plurality of slits 6 at the end opening portion of the main body portion 3, which slits 6 open at the circular grinding face 5 and are parallel with the axis (the center line) L, and circumferentially extend at regular intervals (at intervals of 30° in this case) as shown in FIG. 3.

These slits 6 are provided in order to expel shavings from the space between the grinding face 5 and the ball 1, and can differ freely in length, width, intervals to be arranged, and other conditions. It is also possible to omit these slits 6.

The grain size of the circular grinding face 5 is desired to be Japanese Industrial Standard grain size #80–800, and more preferably #200–300. Diamond abrasive grain is particularly preferable. That is to say, while the ball cannot be ground and smoothed if the grain is too rough, the grinding time becomes longer and the temperature of the ball surface becomes higher if the grain is too smooth.

In FIG. 2, the outer diametral dimension D of the main body portion 3 is desired to be approximately 29–35 mm, and the inner diametral dimension d of the main body portion 3 is desired to be approximately 22–28 mm, and it is preferable to arrange the outer diametral dimension D and the inner diametral dimension d so that the thickness T becomes approximately 2–7 mm. That is to say, the main body portion 3 becomes inferior in strength if the thickness T is less than 2 mm, and wasteful portion increases in the circular grinding face 5 if the thickness T is more than 7 mm.

The shaft portions 4 of the grinding tools 2 are respectively supported by a driving mechanism, which is not shown in the attached drawings, and the driving mechanisms drive and turn the grinding tools 2 on their respective center lines L. It is possible to move the grinding tools 2 along the direction of their respective center lines L in order to adjust the distances from the definite point O to the grinding faces 5 of the grinding tools 2. The appropriate number of revolutions of the grinding tools 2 is 200–400 rpm, and preferably 250–350 rpm.

Explained below is a method for grinding a golf ball surface according to the present invention using the apparatus for grinding a golf ball surface composed as described in the foregoing.

Figure 1:
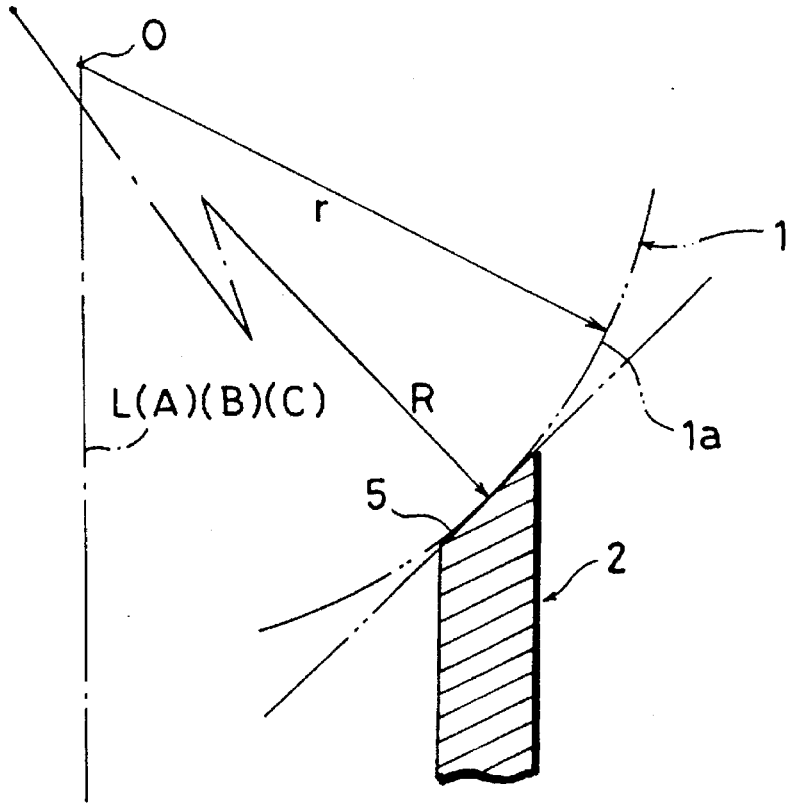
FIG. 1 is an expanded sectional view of a principal portion of a grinding tool used in a method for grinding a golf ball surface according to the present invention.

First, remove flashes at an equatorial position of a molded golf ball 1 by using an apparatus (not shown) for cutting and removing flashes, and hold the golf ball 1 with three grinding tools 2 as shown in FIG. 5. In this case, the surface la of the golf ball 1 touches the circular grinding faces 5 of the grinding tools 2 as shown in FIGS. 1 and 5, which grinding tools 2 are disposed to be equidistant from a definite point O.

Next, under this situation, a thin outer layer T (see FIG. 4) of the golf ball 1 is ground and removed by making the grinding tools 2 revolve in the same direction with equal numbers of revolutions. The equality in the numbers of revolutions is merely approximate in the present invention.

In this case, the radius of curvature R of the circular grinding face 5 is infinite (∞)—the radius of curvature R is larger than the radius r of the golf ball 1—and the contacting area of the surface 1*a* of the golf ball 1 against the grinding face 5 is small, therefore the temperature of the surface 1*a* does not rise excessively when the golf ball 1 is ground, which enables effective grinding.

Figure 4:
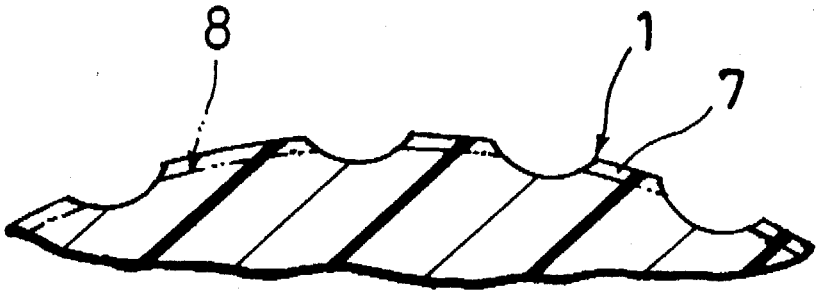
FIG. 4 is an expanded sectional view of a principal portion of a golf ball.

The grinding amount, i.e. the thickness of the thin outer layer T, shall be the amount (dimension) which causes the paint to have relatively strong adhesion to the cover surface 8 after the thin outer layer T is removed (see FIG. 4). To be precise, the thickness of the thin outer layer 7 shall be 0.01–0.02 mm, and the grinding amount shall be 10–30 mg, and preferably 10–26 mg, and these figures can be satisfied when the thin outer layer 7 is ground by using the apparatus described in the foregoing.

After being ground by using the apparatus for grinding a golf ball surface according to the present invention, paint was applied on the golf ball in order to manufacture a golf ball as a product, and performance (capability) of the golf ball was examined as follows.

That is to say, flashes at an equatorial position of a molded golf ball was removed using a separate apparatus for removing flashes, then a thin outer layer 7 thereof was removed using the apparatus for grinding a golf ball surface illustrated in the attached drawings the golf ball was treated preparatory to painting and the golf ball was painted. Next, the golf ball was marked and a clear urethane primer was applied on the golf ball as a topcoat in order to complete the golf ball. Table 1 is the results of the experiment on flying performance (carry) of said golf ball. As for the covers of the golf balls, ionomer is to be used as the main component (at least 50%, preferably at least 80%, and more preferably at least 90%).

TABLE 1

| | 1̂ | 2̂ | 3̂ | 4̂ | 5̂ | 6 |
|---|---|---|---|---|---|---|
| The Weight of the Shavings Produced by Grinding the Ball (mg) | 25 | 15 | 50 | 50 | 25 | 0 |
| Radius of Curvature :R | ∞ | ∞ | the same with the radius of the ball | ∞ | the same with the radius of the ball | — |
| Change in the Depth of the Dimples (mm) | 1.9/100 | 1.2/100 | 3.0/100 | 3.2/100 | 2.5/100 | 0 |
| Equatorial | ground | ground | not | not | not | ground |

TABLE 1-continued

| | 1 | 2 | 3 | 4 | 5 | 6 |
|---|---|---|---|---|---|---|
| Flashes External Appearance of the Ball | good | good | ground flawed | ground good | ground some equato-rial flashes remain | good |
| Chunking on the Ball | not formed | not formed | not formed | not formed | not formed | formed |
| Carry (m) | 202 | 203 | 198 | 198 | 198 | 197 |
| Trajectory Angle of Elevation (°) | 13.3 | 13.1 | 13.9 | 13.8 | 12.9 | 12.7 |
| Dispersion Range in the Trajectory Angle of Elevation | 0.1 | 0.1 | 0.4 | 0.5 | 0.2 | 0.1 |

① and ② in Table 1 are the results when three grinding tools 2 were used each of which having a main body portion 3 of 32 mm in the outer diametral dimension and 25 mm in the inner diametral dimension and a grinding face 5 of # 230, and when grinding a ball, pressure toward the grinding face 5 was arranged to be 3 Kg, and the grinding tools 2 were turned toward the same direction at a number of revolution of 300 rpm (for 4 to 8 seconds).

"Chunking on the Ball" indicates whether chunking is formed on the ball surface when the ball is shot with an No. 9 iron using a machine for shooting balls produced by True Temper Co., Ltd. (U.S.A.) so that the speed at the club head is 32 m/s. In case of the golf balls of ① and ②, some lines were formed on the paint surface owing to the face grooves of the iron club surface, however, the external appearances of the balls were good.

"Carry" is a distance a golf ball flies when the golf ball is hit with a No. 1 wood golf club so that the speed at the club head is 45 m/s, "Trajectory Angle of Elevation" is the vertical angle of the flying path of the golf ball, and "Dispersion Range in the Trajectory Angle of Elevation" is the range the trajectory angle disperses.

In case of ③ in Table 1, the radius of curvature R of the grinding face 5 was arranged to be the same with the radius r of the golf ball 1, and flashes at the equatorial position were not ground beforehand. In this case, the flying performance was low and the dispersion range in the trajectory angle of elevation was large because the weight of the shavings produced by grinding the ball amounted to 50 mg and change in the depth of the dimples amounted to 3.0/100 mm. In addition, the shavings collected between the grinding face and the ball, and the cover material melted and stuck to the grinding face due to the friction heat, therefore many cracks were formed on the ball surface.

The golf ball of ④ was ground with the same grinding tools 2 as used in the cases of ① and ②, and flashes at the equatorial position were not ground beforehand as well as in the case of ③. The shavings were rapidly expelled from the space between the grinding face and the ball, and the external appearance of the ball was good because the shavings do not exert any baneful influence, however, the flying performance was low and the dispersion range in the trajectory angle of elevation was large as well as the golf ball of ③ because the weight of the shavings and the change in the depth of the dimples were large.

The golf ball of ⑤ was ground with the same grinding tools 2 as used in the case of ③, and the weight of the shavings was reduced to 25 mg. Flashes at the equatorial position were not ground beforehand and a part of the flashes remained, therefore the external appearance was bad and the flying performance was low.

for the golf ball of ⑥, only the flashes at the equatorial position were ground. In this case, the external appearance was good, however, the golf ball was not favorable because the face grooves of the golf club forms chunking on the paint.

The results of the experiment shows that golf balls of ① and ②, formed by using the apparatus for grinding a golf ball surface, effectively prevents chunking (a phenomenon in which cover portion is scraped off along with paint portion), and moreover, dimensions and forms of the dimples can be formed with high accuracy, therefore they excel in flying performance.

Figure 6:
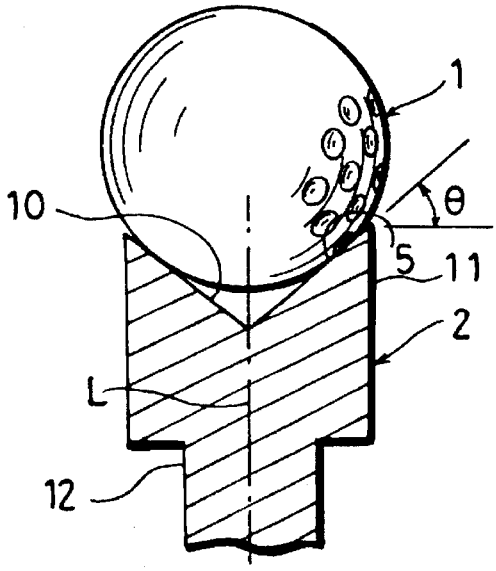
FIG. 6 is a sectional view of a grinding tool of another embodiment.

Next, FIG. 6 shows a modification of the grinding tool 2, and in this case, the grinding tool 2 consists of a solid main body portion 11 having a conical blind hole portion 10 and a shaft portion 12 connected to said main body portion 11.

A part of the wall face of the conical hole portion 10 is to be a circular grinding face 5. The radius of curvature R of this grinding face 5 is therefore arranged to be larger than a radius r of a golf ball 1, and this grinding tool 2 grinds and removes a thin outer layer 7 without excessively raising the temperature of the surface 1*a* of the golf ball 1 as well as the grinding tool 2 described in the foregoing and shown in FIG. 2.

The angle of inclination θ of the circular grinding face 5 in this case is also arranged to be approximately 45° (to be more precise, in the vicinity of 39°–51° ).

Figure 7:
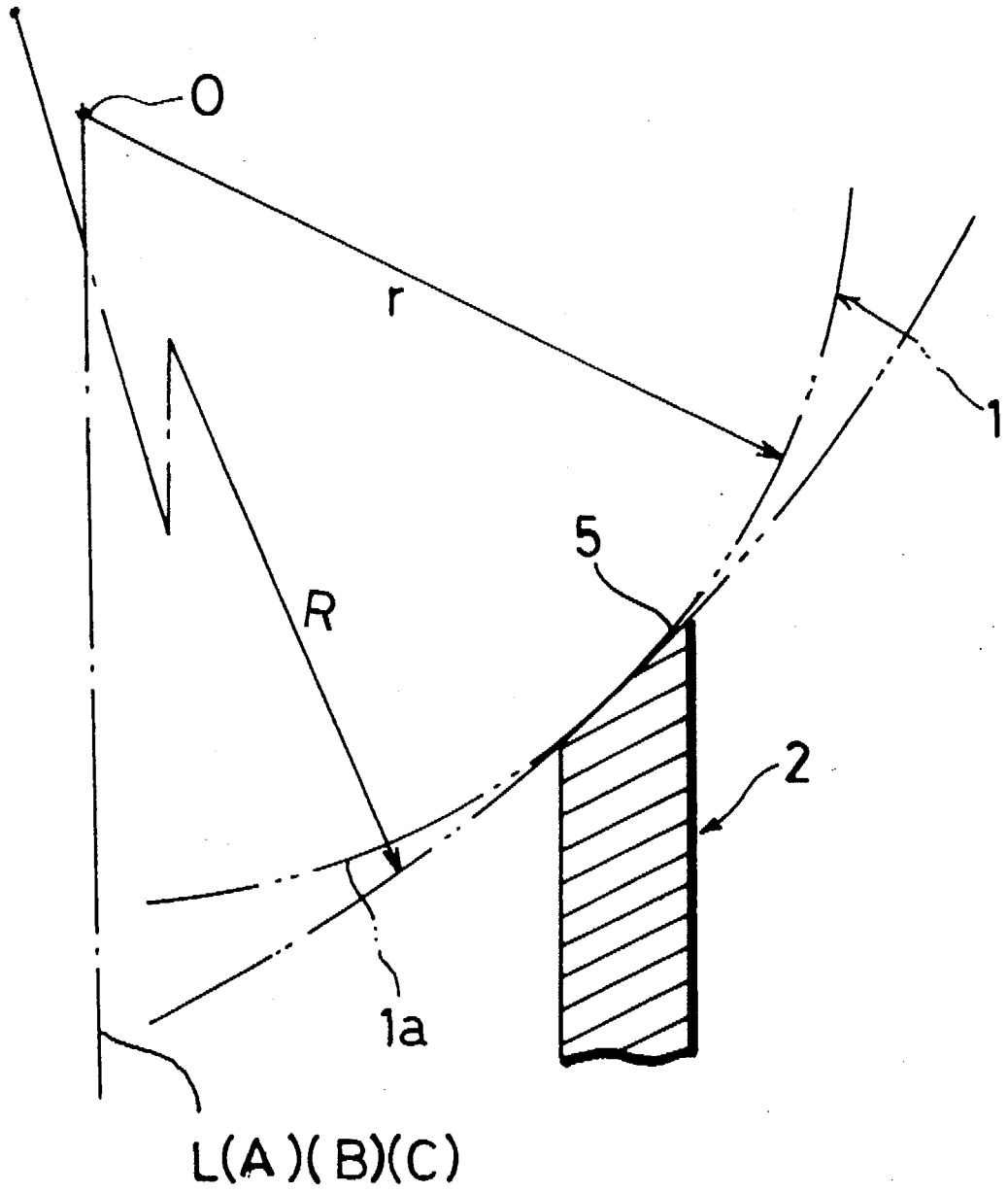
FIG. 7 is an expanded sectional view of a principal portion of a grinding tool of still another embodiment.

By way of parenthesis, the radius of curvature R of the circular grinding face 5, which is infinite (∞) in the embodiments described in the foregoing, can be a concave curved face which radius of curvature R is much larger than a radius r of a golf ball 1 as shown in FIG. 7.

As for the radius r of a golf ball 1, the radius can be that of a golf ball 1 before grinding (that is, a molded golf ball material wherein flashes at the equatorial position have been removed but a thin outer layer 7 is not ground) or that of a golf ball 1 after grinding (that is, a molded golf ball material which thin outer layer 7 has been ground and removed), because while the radius r of the golf ball 1 before grinding and that of the golf ball 1 after grinding are almost the same, the radius of curvature R of the circular grinding face 5 is arranged to be very much larger than these radiuses r.

In the method for grinding a golf ball surface according to the present invention, a thin outer layer 7 of a golf ball 1 is ground and smoothed without excessively raising the temperature of the surface 1*a* of the golf ball 1, and moreover, grinding the thin outer layer 7 enables the golf ball 1 to obtain strong paint adhesion and durability against chunking. The grinding tools 2, which are arranged on three axes A, B, and C on a plane which axes radiate from a definite point O at intervals of 120° between one another, turn on the respective axes (center lines) L in the present method, and these grinding tools 2 grind the thin outer layer 7 extremely thinly and approximately uniformly, therefore configurations and dimensions of the dimples are formed with high accuracy.

As for the golf ball according to the present invention, the thin outer layer 7 of the golf ball material is ground, which raises surface activeness and adhesion of paint, and effectively prevents chunking (a phenomenon in which paint is scraped off along with cover material under the paint) caused by a stroke of a golf club.

While preferred embodiments of the present invention have been described in this specification, it is to be understood that the invention is illustrative and not restrictive, because various changes are possible within the spirit and indispensable features.

We claim:

1. A method for grinding a surface of a golf ball comprising the steps of:

providing three grinding tools, each of which contains a circular grinding face divergent toward an end of said face and having a radius of curvature greater than the radius of said golf ball surface;

mounting said grinding tools on axes of rotation that are disposed on substantially uniform 120° angular spacing and that radiate from the spherical center of said golf ball;

rotating said grinding tools at substantially the same speed in the same direction about said axes of rotation with said grinding faces contacting said golf ball surface to produce shavings therefrom; and cooling the surface of said golf ball engaged by the grinding faces of said grinding tools by expelling said shavings through slits disposed on circumferential spacing about said grinding faces.

2. The method for grinding a surface of a golf ball as set forth in claim 1 wherein the circular grinding face of each tool is formed as a frusto-conical surface having a predetermined angle of inclination with respect to the rotational axis thereof.

3. The method for grinding a surface of a golf ball as set forth in claim 2, wherein the angle of inclination of the frusto-conical surface of the circular grinding face is between about 39° and 51°.

4. The method for grinding a surface of a golf ball as set forth in claim 1 wherein the circular grinding face of each grinding tool is a concave curved face.

5. The method for grinding a surface of a golf ball as set forth in claim 1 wherein each grinding tool has a circular grinding face of Japanese Industrial Standard grain size #80–800 .

6. The method for grinding a surface of a golf ball as set forth in claim 1 wherein each grinding tool has a cylindrical main body portion containing the circular grinding face, and wherein each circular grinding face is 29 to 35 mm in the outer diametral dimension, 22 to 28 mm in the inner diametral dimension, and 2 to 7 mm in the thickness.

7. The method for grinding a surface of a golf ball as set forth in claim 1 wherein the grinding tools revolve at a number of revolutions in the range of from 200 to 400 rpm.

8. The method for grinding a surface of a golf ball as set forth in claim 1 wherein the grinding tools have a main body portion containing a solid body having a conical blind hole portion.

* * * * *

UNITED STATES PATENT AND TRADEMARK OFFICE

CERTIFICATE OF CORRECTION

PATENT NO.: 5,658,188
DATED : August 19, 1997
INVENTOR(S): YAMADA et al.

It is certified that error appears in the above-identified patent and that said Letters Patent is hereby corrected as shown below:

On the title page:

In item [75], the assignee, please change "Sumitomo Rubber Industrues, Ltd.," to be --Sumitomo Rubber Industries, Ltd.,-- therefor.

Signed and Sealed this

Ninth Day of June, 1998

*Attest:*

Bruce Lehman

BRUCE LEHMAN

*Attesting Officer*

*Commissioner of Patents and Trademarks*